US008684786B2

(12) United States Patent
Chan

(10) Patent No.: US 8,684,786 B2
(45) Date of Patent: Apr. 1, 2014

(54) INTERACTIVE TALKING TOY WITH MOVEABLE AND DETACHABLE BODY PARTS

(75) Inventor: Albert Wai Tai Chan, Taipei (TW)

(73) Assignee: Thinking Technology Inc. (BS)

( * ) Notice: Subject to any disclaimer, the term of this patent is extended or adjusted under 35 U.S.C. 154(b) by 100 days.

(21) Appl. No.: 13/391,121

(22) PCT Filed: Aug. 19, 2010

(86) PCT No.: PCT/CA2010/001280

§ 371 (c)(1),
(2), (4) Date: Jun. 6, 2012

(87) PCT Pub. No.: WO2011/020192

PCT Pub. Date: Feb. 24, 2011

(65) Prior Publication Data

US 2012/0252306 A1 Oct. 4, 2012

(30) Foreign Application Priority Data

Aug. 20, 2009 (CA) ..... 2675913

(51) Int. Cl.
*A63H 3/20* (2006.01)
*A63H 3/46* (2006.01)

(52) U.S. Cl.
USPC ..... 446/330; 446/175; 446/484

(58) Field of Classification Search
USPC ..... 446/175, 297, 298, 327, 330, 376, 484
See application file for complete search history.

(56) References Cited

U.S. PATENT DOCUMENTS

| | | | | |
|---|---|---|---|---|
| 4,869,701 | A | 9/1989 | Kawai et al. | |
| 4,923,428 | A * | 5/1990 | Curran | 446/175 |
| 6,149,490 | A * | 11/2000 | Hampton et al. | 446/353 |
| 6,160,986 | A | 12/2000 | Gabai et al. | |
| 6,257,948 | B1 | 7/2001 | Silva | |
| 6,309,275 | B1 * | 10/2001 | Fong et al. | 446/297 |
| 6,702,644 | B1 | 3/2004 | Hornsby et al. | |
| 7,131,887 | B2 | 11/2006 | Hornsby et al. | |
| 2007/0128979 | A1 | 6/2007 | Shackelford et al. | |

FOREIGN PATENT DOCUMENTS

| | | |
|---|---|---|
| JP | U-H6-7796 | 2/1994 |
| JP | 3090370 | 12/2002 |
| JP | 2004318026 | 11/2004 |

OTHER PUBLICATIONS

Machine translations of portions of JP-U-3090370 cited in Japanese Office Action dated Aug. 13, 2013 for Japanese Patent Application No. 525006/2012, 20 pgs.
Machine translations of portions of JP-U-H06-7796 cited in Japanese Office Action dated Aug. 13, 2013 for Japanese Patent Application No. 525006/2012, 5 pgs.
English Abstract for JP 2004-318026, Nakagawa Tomohito, 1 pg, Nov. 2004.

(Continued)

*Primary Examiner* — Kien Nguyen
(74) *Attorney, Agent, or Firm* — Fredrikson & Byron, P.A.

(57) ABSTRACT

An interactive talking toy with moveable and detachable body parts has the ability to talk, sing, move and dance in response to voice input from the user. Various motors, actuators, microphones, speakers and integrated circuit means are used to control and customize the movement of the toy and the accompanying sounds, based on a combination of pre-programmed parameters and real-time input from various sensors. The toy provides the user a high degree of interactivity, as well as humour, spontaneity and unpredictability.

10 Claims, 4 Drawing Sheets

(56) References Cited

OTHER PUBLICATIONS

English translation of Office Action dated Aug. 13, 2013 for Japanese Patent Application No. 525006/2012 (2 pgs.).

"PCT International Search Report dated Dec. 8, 2010 for PCT/CA2010/001280, from which the instant application is based," 2 pgs.

"PCT Written Opinion dated Dec. 8, 2010 for PCT/CA2010/001280, from which the instant application is based," 3 pgs.

International Preliminary Report on Patentability and Written Opinion for International Application No. PCT/CA2010/001280, dated Feb. 21, 2012, 5 pages.

* cited by examiner

INTERACTIVE TALKING TOY WITH MOVEABLE AND DETACHABLE BODY PARTS

RELATED APPLICATIONS

This application is a 35 U.S.C. 371 national stage filing from International Application No. PCT/CA2010/001280 filed Aug. 19, 2010, and claims priority to Canadian Application No. 2,675,913 filed Aug. 20, 2009. The entire contents of these references are incorporated herein by reference.

FIELD OF THE INVENTION

This invention relates to interactive talking toys with moveable and detachable body parts.

BACKGROUND

In the field of toys, talking toys and toys with moveable and detachable body parts are well-known. However, to date there has not been any interactive talking toy with moveable and detachable body parts that can provide the user a customized portfolio of phrases and body movements that changes according to which body parts are attached and which are not attached at any given moment. Furthermore, there has not been in the prior art an interactive toy that combines the above features with the ability to output vocal and mechanical responses in specific ways, depending on the loudness and repetition patterns of the sounds input from the user. Furthermore, there has not been in the prior art an interactive toy that combines the above features with the ability to eject (strip itself of) its body parts in a spring-loaded fashion, in response to sounds and voice inputs.

Accordingly, it would be desirable to have such an interactive talking toy with moveable and detachable body parts which could provide the user a high degree of interactivity, as well as humour, spontaneity and unpredictability.

SUMMARY OF THE INVENTION

The present invention answers, to a substantial degree, the need for an interactive talking toy with moveable and detachable body parts that combines all of the above-mentioned desired characteristics into one package.

Accordingly, in various aspects of the present invention, an interactive talking toy with moveable and detachable body parts is provided that:

- responds to touch, voice, and sound inputs from the user and from the environment;
- responds by speaking, grunting, singing, dancing and moving of body parts;
- provides a customized portfolio of phrases;
- has the ability to synchronize its movements with its speaking and singing;
- provides phrases, songs, motions, mood and tone of voice that change according to which body parts are attached and which are not attached at any given moment;
- has the ability to eject (strip itself of) its body parts in response to sounds and voice inputs;
- is amenable to tool-less, snap-in-place assembly and disassembly.

These and other aspects and advantages of the present invention will be apparent to those skilled in the art upon consideration of the following detailed description in conjunction with the accompanying drawings.

DETAILED DESCRIPTION OF THE PREFERRED EMBODIMENT

Figure 1:
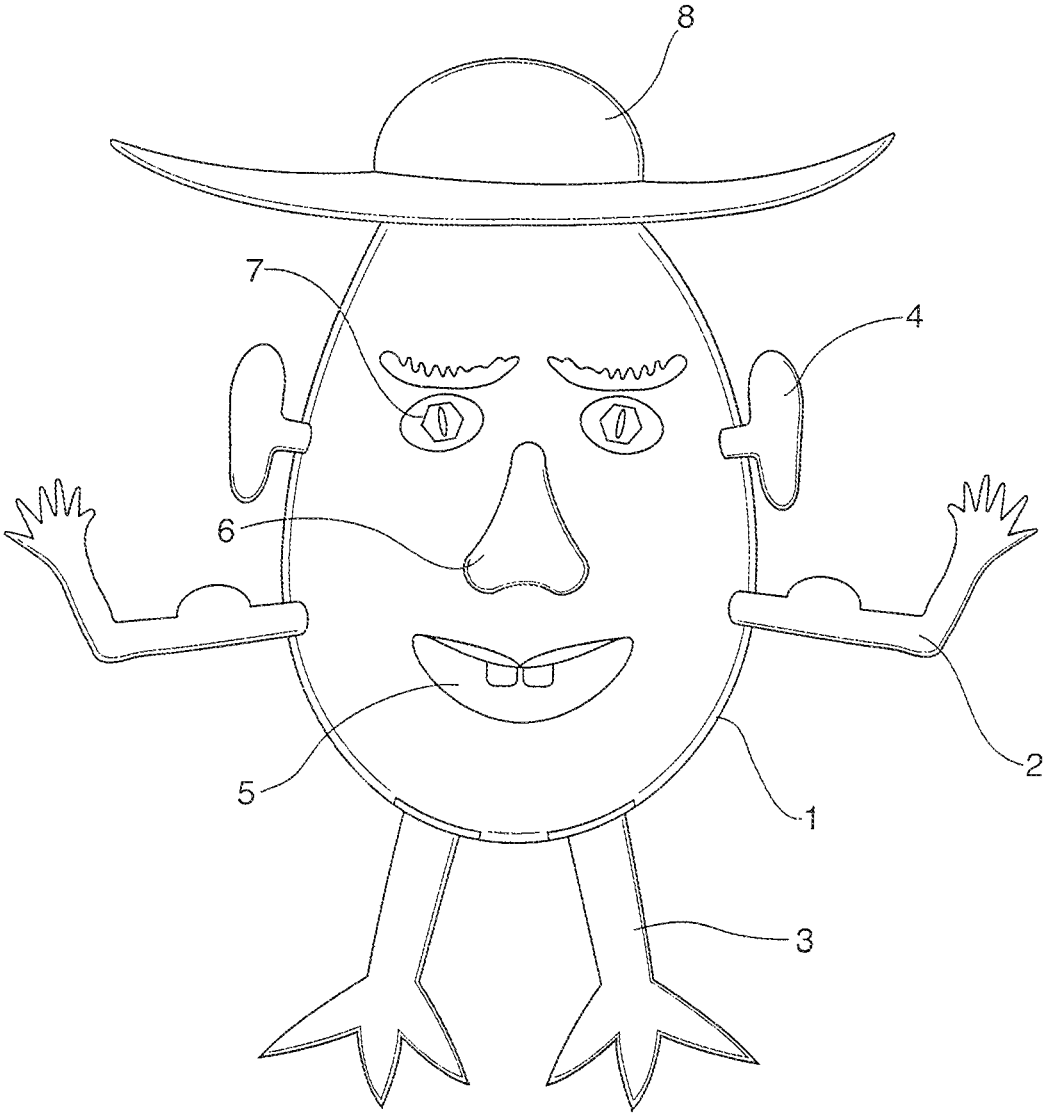
FIG. 1 is a frontal view of a preferred embodiment, with sample appendages attached.
Figure 2:
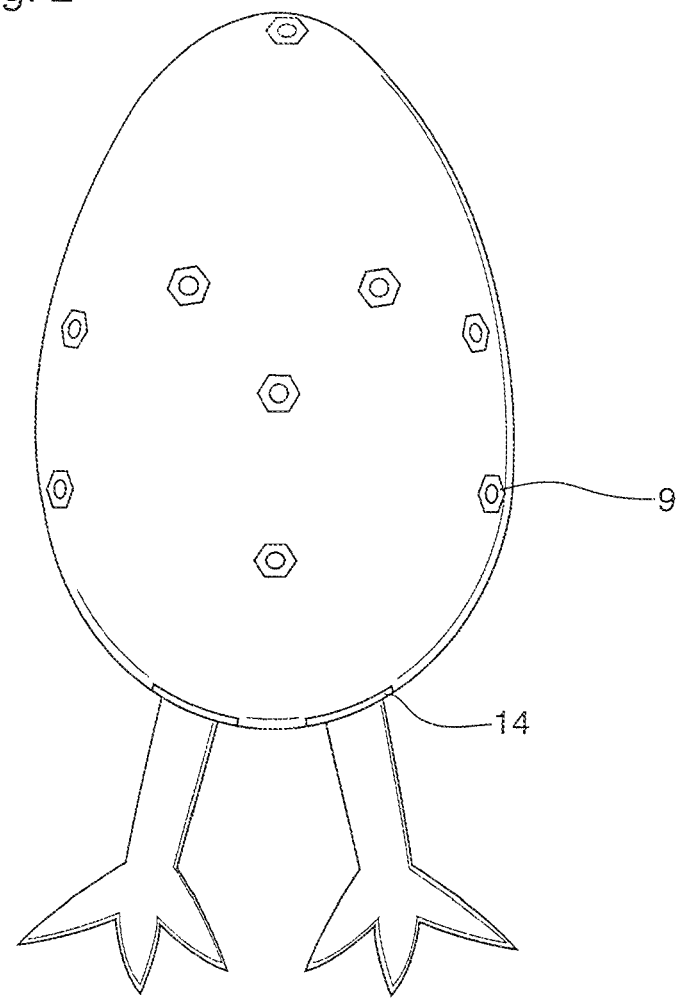
FIG. 2 is a frontal view of the preferred embodiment, with all removable appendages removed.

In a preferred embodiment, the toy has a main body and appendages. Referring to FIGS. 1-2, external appendages such as hands/arms (2), legs (3), or clothing accessories, and head appendages, such as ears (4), lips/mouth (5), nose (6), eyes/eyebrows (7), hat (8), can be attached to the body (1). The external appendages are attached to the body via articulations (9) that allow the transmission of motion from electric motors (11) and actuators (10), located inside the body, to the external appendages. Except for the leg articulations (14), which are not of the user-detachable type, all other articulations (9) are fitted with biasing means, locks and latches that permit snap-in-place assembly and disassembly of the appendages connected to them.

Figure 4:
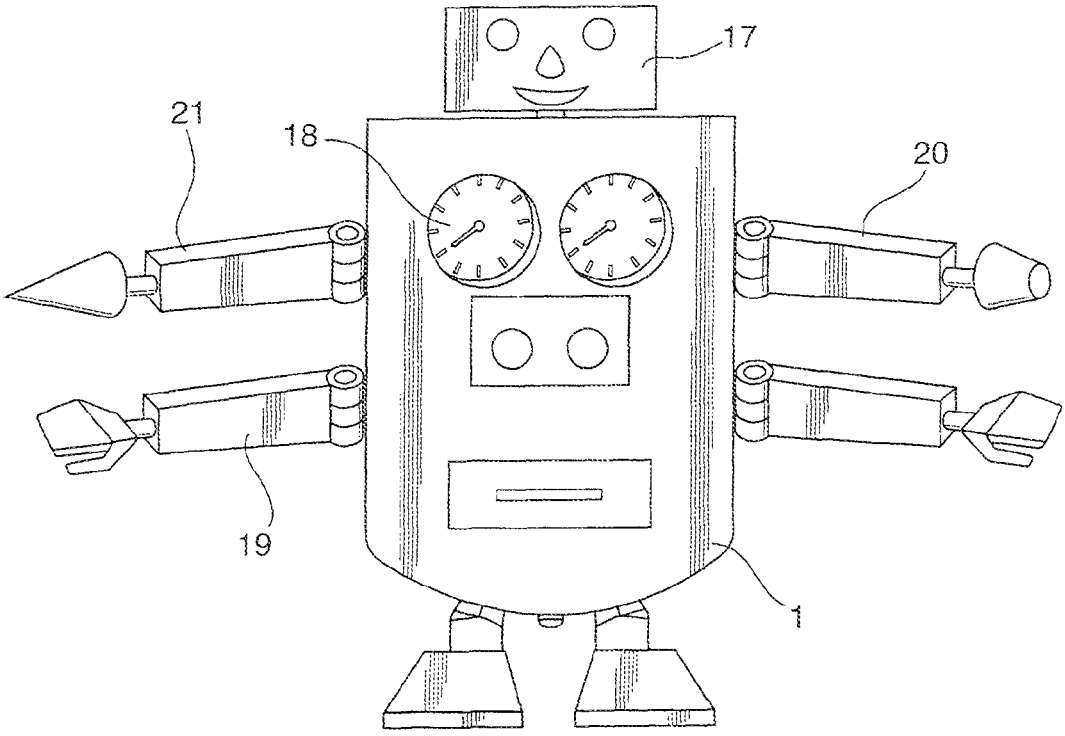
FIG. 4 is a frontal view of an alternative embodiment, with sample appendages attached.

When "facial" appendages such as lips/mouth (5), nose (6), eyes/eyebrows (7), are attached directly to the body (1), the toy's general appearance is that of a walking/talking head, as in FIGS. 1-2. In alternative embodiments, such as the one shown in FIG. 4, a dedicated "head" appendage (17) is present, and various other "non-facial" appendages are attached to the body (1), such as gauges (18), arms (19), tool implements (20), weapon implements (21), wheels, propellers, tentacles, branches, pieces of armour, wings, reels, etc. By combining a body (1) of a suitable shape with the properly matching appendages, various toy configurations and embodiments can be offered: human, cartoon character, robot, animal, monster, anthropomorphic object, etc.

Figure 3:
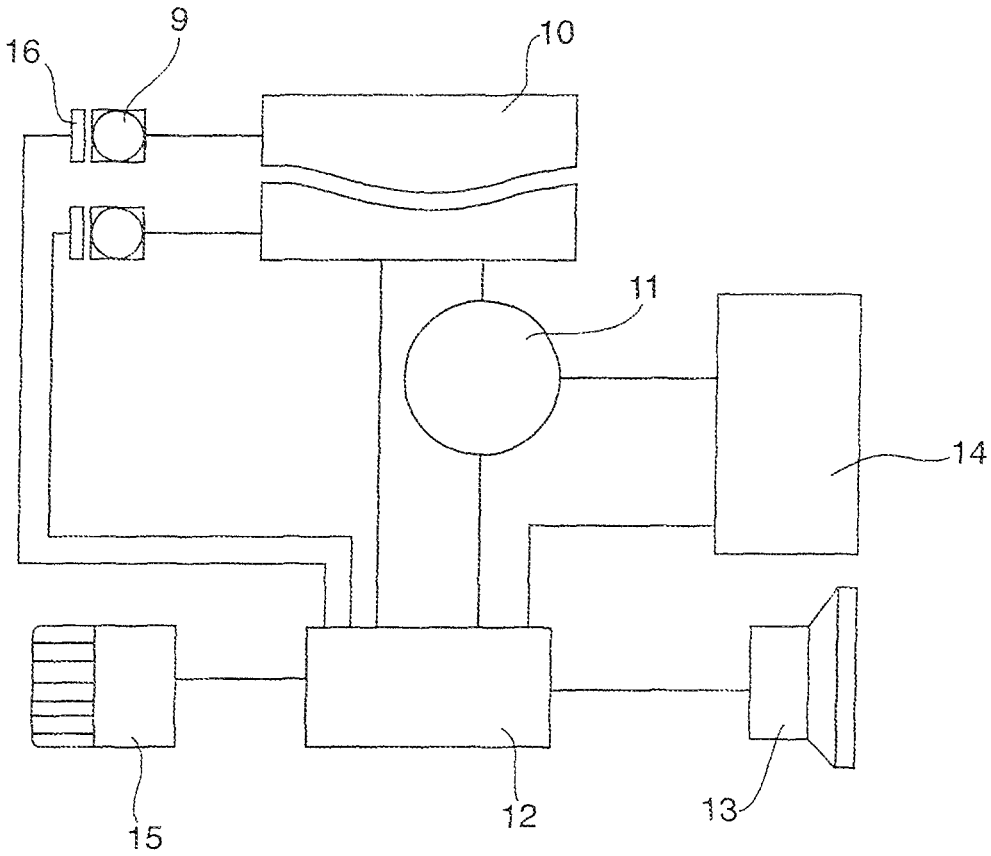
FIG. 3 is an internal schematic diagram of the toy body, showing the functional units.

Located preferably within the body of the toy and shown on the schematic diagram in FIG. 3 are a battery pack (14), one or more motors (11), one or more microphones (15), one or more speakers (13) and one or more actuators (10) that convert and transmit the driving force from the motors (11) to the articulations (9). The actuators (10) are also able to effect the spring-loaded release (ejection) of appendages from the articulations (9), for a surprising and spectacular "pop off" effect. In various embodiments of this invention, the actuators (10) may comprise one or more gears, gearboxes, shafts, plates, belts, pulleys, levers, switches, pistons, biasing means, eccentric wheels, ejection pins, racks and pinions, etc.

Sensors (16), located preferably within the articulations (9), sense which articulations have appendages connected to them, and can furthermore sense which particular attachment is connected to any given articulation. Sensors (16) can also sense when an appendage is being moved or pushed by the user. The information gathered by the sensors (16) is inputted, as mechanical or electrical signals, to one or more integrated circuit electronic control modules (12), also located preferably within the body of the toy. The control modules (12) are used to manage the movement of the appendages via control of motors (11) and actuators (10), and to also manage the sounds produced by the toy, via control of speakers (13). The control modules (12) base their response on a combination of pre-programmed parameters and real-time input from sensors (16) and microphones (15). An internal timer also allows the control modules (12) to detect the prolonged absence of any mechanical or sound input and, in response, to either prompt the user to play with the toy, or to put the toy in power save mode, or to turn the power off altogether.

In a preferred embodiment, the toy's electronic control modules (12) are also used to store a customized portfolio of pre-recorded phrases and music. Whenever an user touches, moves or pushes an appendage attached to the toy, or in response to external voice and sound inputs from the user (and/or from the environment), the control modules (12) cause the toy to talk, grunt, sing, whistle, dance and move its body parts. The control modules (12) also give the toy the ability to synchronize its speaking and singing with its mechanical movement and the movement of appendages.

In a further preferred embodiment, the toy comes with a set of multiple distinct external appendages for each articulation point (9) on its body. Within each such set, distinct appendages can illustrate distinct moods, personalities and characters of the toy. Within each such set, distinct appendages can have distinct means to engage the sensors (16). Such distinctive engaging of sensors allows the toy's control modules (12) to be aware which appendages are attached to the body at any given moment and, in response to this information, to provide a range of motion and sound output that best fits the current appendage configuration. For example, attaching a "happy eyes" appendage to the body, would cause the toy to respond with light-hearted talk and dance moves, whereas attaching an "angry eyes" appendage would elicit harsher phrases and threatening moves. Through the same sensors (16), the toy's control modules (12) can also be informed when no appendages are present within certain articulations (9) on the toy's body and, in response to this information, cause the toy to react appropriately and logically (e.g. the toy would comment about the missing appendage(s), or the toy would not talk when the "mouth" appendage (5) is not attached, or the toy would pretend not to respond to voice prompts when the "ear" (4) appendages are not connected, etc).

In a further preferred embodiment, the toy comes with one or more built-in microphones (15) that allow the control modules (12) to detect the intensity or repetition patterns associated with the incoming sounds, and, in response to this information, to provide a range of pre-programmed motions and sound outputs that best fit the pattern of the sound input. For example, a whisper by the user elicits a different mechanical/audible response from the toy compared to a shout or a loud noise; similarly, one clap of hands by the user elicits a different response from the toy compared to three consecutive claps.

In a further preferred embodiment, the toy's control modules (12) are capable of a wider range of preset responses that include the ability to send a command to the motors (11) and actuators (10) to eject one or more appendages from their articulations (9) on the body. One or more dedicated push buttons can also be provided on the toy body for the user to manually trigger the ejection of one, or more, or all appendages from their articulations on the body. Appendages can equally be manually released one by one from the articulations by a user's outward pulling action.

It will be apparent to those skilled in the art, after reviewing this description, that many changes, modifications, variations and other uses and applications for the subject interactive talking toy with moveable and detachable body parts, in addition to those which have been disclosed are possible and contemplated, and all such changes, modifications, variations and other uses and applications which do not depart from the spirit and scope of the invention are deemed to be covered by the invention which is limited only by the claims which follow.

The invention claimed is:

1. A toy comprising:

a) a body fitted with motor means and actuation means;

b) one or more appendages;

c) one or more articulation means, each for releasably forming a connection between each said appendage and the body, each said articulation means adapted to reversibly release said connection, each said articulation means adapted to engage and receive one of said appendages in a snap-in fashion and re-form said connection, each said articulation means adapted to allow the transmission of motion from the actuation means to one said appendage connected into said articulation means;

d) receiving means to generate a first processor signal when sounds are detected;

e) communication means comprising an audible sound emitting device;

f) one or more sensor means, each for generating a second processor signal when a connection is formed between one or more of said appendages and the body, and each for generating a third processor signal when an user moves or touches one or more of said appendages connected into said articulation means;

g) control apparatus connected to govern operation of the motor means, the actuation means and the communication means;

wherein the motor means generate a mechanical driving force, and wherein the actuation means selectively transmit the driving force to one or more of said articulation means.

2. A toy according to claim 1 wherein the control apparatus governs the operation of said motor means, actuation means and communication means, based on the first processor signal input received from the receiving means.

3. A toy according to claim 1, wherein the control apparatus further governs the operation of said motor means, actuation means and communication means, based on the second processor signal input received from the sensor means.

4. A toy according to claim 1, wherein the control apparatus further governs the operation of said motor means, actuation means and communication means, based on the third processor signal input received from the sensor means.

5. A toy according to claim 1, wherein the control apparatus comprises integrated circuit means.

6. A toy according to claim 1, wherein the motor means comprise one or more electrical motors.

7. A toy according to claim 1, wherein the receiving means comprise one or more microphones.

8. A toy according to claim 1, wherein the communication means comprises sound generating means adapted to mimic human speech and singing.

9. A toy according to claim 1, wherein the communication means comprise an integrated circuit having a series of pre-recorded phrases and songs, and an audio speaker adapted to receive signals from said integrated circuit.

10. A toy according to claim 1, wherein the control apparatus can cause the release of the connections between one or more said appendages and said body.

* * * * *